US006490420B2

(12) United States Patent
Pollocks, Jr.

(10) Patent No.: US 6,490,420 B2
(45) Date of Patent: Dec. 3, 2002

(54) SECURITY METHOD FOR A SMART CARD

(75) Inventor: Lonnie J. Pollocks, Jr., Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/022,897

(22) Filed: Dec. 20, 2001

(65) Prior Publication Data

US 2002/0076224 A1 Jun. 20, 2002

Related U.S. Application Data

(63) Continuation-in-part of application No. 09/745,171, filed on Dec. 20, 2000, now Pat. No. 6,351,618.

(51) Int. Cl.[7] ..... G03G 15/00
(52) U.S. Cl. ..... 399/12
(58) Field of Search ..... 399/12, 13

(56) References Cited

U.S. PATENT DOCUMENTS

| | | | | |
|---|---|---|---|---|
| 4,327,993 A | | 5/1982 | Gauronski et al. | 355/14 SH |
| 4,585,327 A | | 4/1986 | Suzuki | 355/3 R |
| 4,751,484 A | | 6/1988 | Matsumoto et al. | 355/14 |
| 4,807,868 A | | 2/1989 | Hirst et al. | 271/256 |
| 4,961,088 A | | 10/1990 | Gilliland et al. | 355/206 |
| 5,016,171 A | | 5/1991 | Connolly et al. | 364/406 |
| 5,132,729 A | * | 7/1992 | Matsushita et al. | 399/12 X |
| 5,157,726 A | | 10/1992 | Merkle et al. | 380/23 |
| 5,191,611 A | | 3/1993 | Lang | 380/25 |
| 5,272,503 A | | 12/1993 | LeSueur et al. | 355/208 |
| 5,486,899 A | * | 1/1996 | Iimori et al. | 399/24 |
| 5,579,088 A | * | 11/1996 | Ko | 399/12 |
| RE35,751 E | | 3/1998 | Midgley | 399/25 |
| 5,987,134 A | | 11/1999 | Shin et al. | 380/25 |
| 6,181,885 B1 | | 1/2001 | Best et al. | 399/12 |

* cited by examiner

*Primary Examiner*—Fred L. Braun

(57) ABSTRACT

A security method for smart cards used for accessing appliances or the like. The smart card is provided with a memory source having a plurality of addressed floating memory locations. Periodically, one of the floating memory locations is randomly selected as a security location and a security code is written in the security location. The security code and the address of the security location in the card's memory device is stored in the appliance's memory or in a central controllers memory. Periodically, the code in the floating memory location at the address stored in the appliance memory device is compared with the security code in the appliance memory device. If the two codes are not the same, then an alert code is written into each of the memory locations and/or the smart card is disabled. If the two codes are the same, then the appliance is placed in a stand by mode ready to provide service.

10 Claims, 7 Drawing Sheets

SECURITY METHOD FOR A SMART CARD

RELATED APPLICATIONS

This application is a Continuation-In-Part of U.S. patent application Ser. No. 09/745,171 filed on Dec. 20, 2000, now U.S. Pat. No. 6,351,618.

FIELD OF THE INVENTION

The present invention relates to a security system for ensuring that smart cards, such as ID/security badges, pre-paid debit cards, automatic billing cards and the like, are being used within their effective lifespan and according to any existing pre-paid fees, warranty or license.

BACKGROUND OF THE INVENTION

It is desirable to provide a means by which only the appropriate type of pre-paid, licensed or authorized cartridge or smart card may be used with a specific electrostatographic reproducing machine or other appliance.

If an incorrect or improperly manufactured cartridge is inserted into the machine, it may have a detrimental affect on the quality and/or quantity of the documents produced by the machine. Furthermore, an improperly or poorly designed cartridge may detrimentally affect components of the electrostatographic reproducing machine, and may therefore void any warranty on the machine. It is also important to ensure that CRU's (Customer Replaceable Units) are not used beyond the useful life of the CRU. Using a CRU beyond its useful life may likewise have a detrimental effect on print quality and/or on machine components, possibly voiding any warranty. In some instances, it is desirable to determine whether a machine being operated under a contract, license or pre-paid fee is being used in accordance therewith.

In order to automatically determine whether a replaceable cartridge or CRU is the correct type of CRU upon insertion of the CRU into the machine, it is known to provide the CRU with a monitoring device commonly referred to as a CRUM (Customer Replaceable Unit Monitor). A CRUM is typically a memory device, such as a ROM, EEPROM, SRAM, or other suitable non-volatile memory device, provided in or on the cartridge. Information identifying the CRU is written on the EEPROM during manufacture of the CRUM. For example, information identifying a CRU as a developer cartridge and identifying the type of carrier, developer, and transfer mechanism contained in the developer cartridge may be written in the memory contained in the CRUM. When a CRU containing such a CRUM is installed in a machine, the machine's control unit reads the identifying information stored in the CRUM. If the CRU is the wrong type of unit for the machine, then a "Wrong Type of Cartridge" message is displayed on the machine's control panel and the machine is deactivated. Use of an incorrect cartridge or CRU is thus prevented. Such a "security CRUM" system is disclose in U.S. Pat. No. 4,961,088 issued to Gilliland et al.

The maximum number of prints that a CRU is designed, licensed, pre-paid or warranted to produce is also commonly programmed into memory during manufacture of the CRU or smart card. When a given cartridge has reached its maximum number of prints, the machine is disabled and a "Change Cartridge" message is displayed on the control panel. The spent CRU must be removed and a new CRU must be installed in order to reactivate the machine and continue making prints. Prior to removal of the spent CRU, the machine's control unit writes data indicating that the CRU has been exhausted into the CRUM's memory. Should a spent cartridge be reinserted into the machine, the control unit will identify the CRU as a spent CRU upon reading the CRUM. Upon identifying a newly installed CRU as a spent CRU, the control unit disables the machine and displays a "Change Cartridge" message on the display panel. Thus, inadvertent reuse of an exhausted CRU is prevented. When remanufacturing a used CRU, the CRUM must be reset or replaced with a new CRUM before the remanufactured CRU may be used in a electrostatographic machine without being identified as an exhausted cartridge.

In order to provide controlled access to appliances, such as printers, copy machines, telecopiers, facsimile machines, satellite television receivers, telephones, pagers, washers and dryers at a Laundromat, video arcade machines, etc. so-called "smart cards" are commonly used. Smart cards are also used to provide automatic individualized billing for use of such appliances and as pre-paid fee for service access cards. A smart card may take the form of a card containing a memory device similar to that of the previously described CRUM. The memory device may be, for example, a ROM, EEPROM, SRAM, magnetic strip, or other suitable non-volatile memory device.

In order to prevent resetting and reuse of spent CRU's and smart cards beyond their effective lifespan, or beyond the term of a pre-paid fee, warranty or license it is known to provide a "kill zone" in the memory of a CRUM or smart card. The known kill zones are a fixed area in the memory that, when an attempt to read or access this portion of the memory is made, disables all functionality of the CRUM or smart card. Once disabled, the CRUM or smart card will no longer function with the corresponding appliance. For example, one or more of the useful datapoints in the memory, such as the datapoint identifying the number of available images or current balance in dollars or pre-paid images (or other unit of service) may be set to zero. Setting such a useful datapoint to zero will cause the appliance to cease operating and display a "Replace Cartridge" or "Current Balance is Zero" message on the display panel. In this way a consumer is prevented from employing a CRU or smart card that has been improperly remanufactured beyond its useful or warranted life, and the possible detrimental consequences in the form of reduced print quality, damage to machine components, contract violation and loss of warranty are prevented.

In some instances, consumers have been successful in identifying the location of the fixed kill zone in existing smart cards and "security CRUM's." After identifying the location of the fixed kill zone, it is possible to access the non-kill zone portions of the memory and reverse engineer its architecture, programming, and identifying information and codes. Upon knowing the architecture and identifying information and codes, it is possible to reprogram spent smart cards and CRUMs for continued use. When extending the life of a CRU in this manner, a consumer may continue to use a degraded CRU with detrimental effects on the overall operation of the machine in terms of print quality or quantity, possibly voiding any warranties and damaging machine components in the process. In other instances, the consumer may be resetting the CRUM or smart card in order to continue operating the machine beyond the terms of a license or contract based on usage, time, or amount pre-paid.

There is a need in the art for an improved method of preventing unauthorized access of the memory of CRUMs and smart cards, in order to prevent reuse of spent CRUs and smart cards beyond their effective or pre-paid life, or beyond the term of a warranty or license.

SUMMARY OF THE INVENTION

The present invention provides a security method for a smart card. The method includes the following steps. Providing the smart card with a memory source having a plurality of addressed floating memory locations. Randomly selecting one of the floating memory locations as a security location. Writing a security code into the security location. Periodically repeating the steps of selecting a security location and writing a security number into the security location.

BRIEF DESCRIPTION OF THE DRAWINGS

The present invention will now be described, by way of example, with reference to the appended drawings, of which.

DETAILED DESCRIPTION OF AN EMBODIMENT OF THE INVENTION

According to one embodiment of the present invention, customer replaceable units (CRU's), in the form of replaceable cartridges, such as toner, developer and Photoreceptor cartridges, are provided with memory devices or CRUM's (Customer Replaceable Unit Monitors). Each CRUM contains data identifying the cartridge as the correct type of cartridge for use with the machine. Although the CRUM security system of the present invention is disclosed herein for use in electrostatographic laser printers, one of ordinary skill in the art will appreciate that the present invention is equally suited for use in a wide variety of processing systems. It will be appreciated a CRUM and security method according to the present invention may be used in electrostatographic and inkjet printers, facsimile machines and copiers, and is not limited to use in the particular embodiment described herein.

Figure 1:
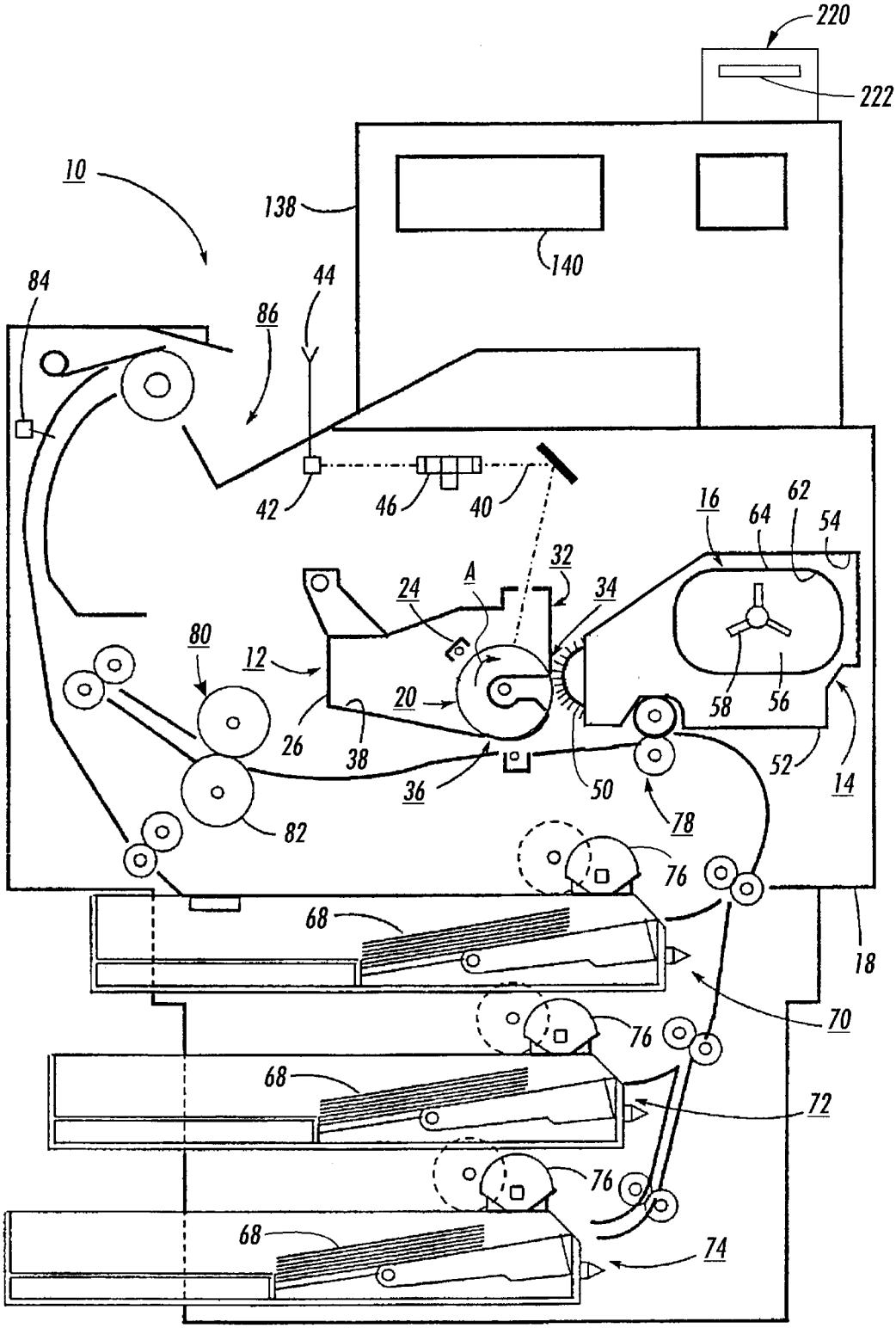
FIG. 1 is a schematic representation in cross section of an automatic electrostatographic reproducing machine having replaceable Photoreceptor, developer, and toner cartridges, each containing a security CRUM according to the teachings of the present invention.

Referring now to FIG. 1, there is shown by way of example an automatic electrostatographic reproducing machine 10 adapted to implement the CRUM security system of the present invention. In the example shown, reproducing machine 10 comprises a laser printer employing replaceable photoreceptor, developer, and toner cartridges or CRU's 12, 14, and 16 respectively. Each cartridge is designed and warranted, and perhaps licensed, to provide a preset maximum number of images X12, X14, and X;16, respectively, in the form of prints or copies. The maximum number of images may be different for each cartridge. When the number of images produced by one of the cartridges reaches a predetermined quantity Y12, Y14, or Y16, which quantity is less than the maximum number of images X12, X14, and X16, a warning that the cartridge is nearing the end of its life is displayed on the machine's display panel. This warning allows the customer time to order a new cartridge, renew a license, call a service technician, or take any other required action. Following the warning, the machine will continue to make the remaining images. When the preset maximum number of images X12, X14, or X16 has been made with one of the cartridges, that cartridge is disabled, a "Replace Cartridge" message is displayed on the control panel, and further operation of the machine is prevented. At this point, the expended cartridge must be removed from the machine and a new cartridge installed in its place, before further operation of the machine is possible.

Figure 2:
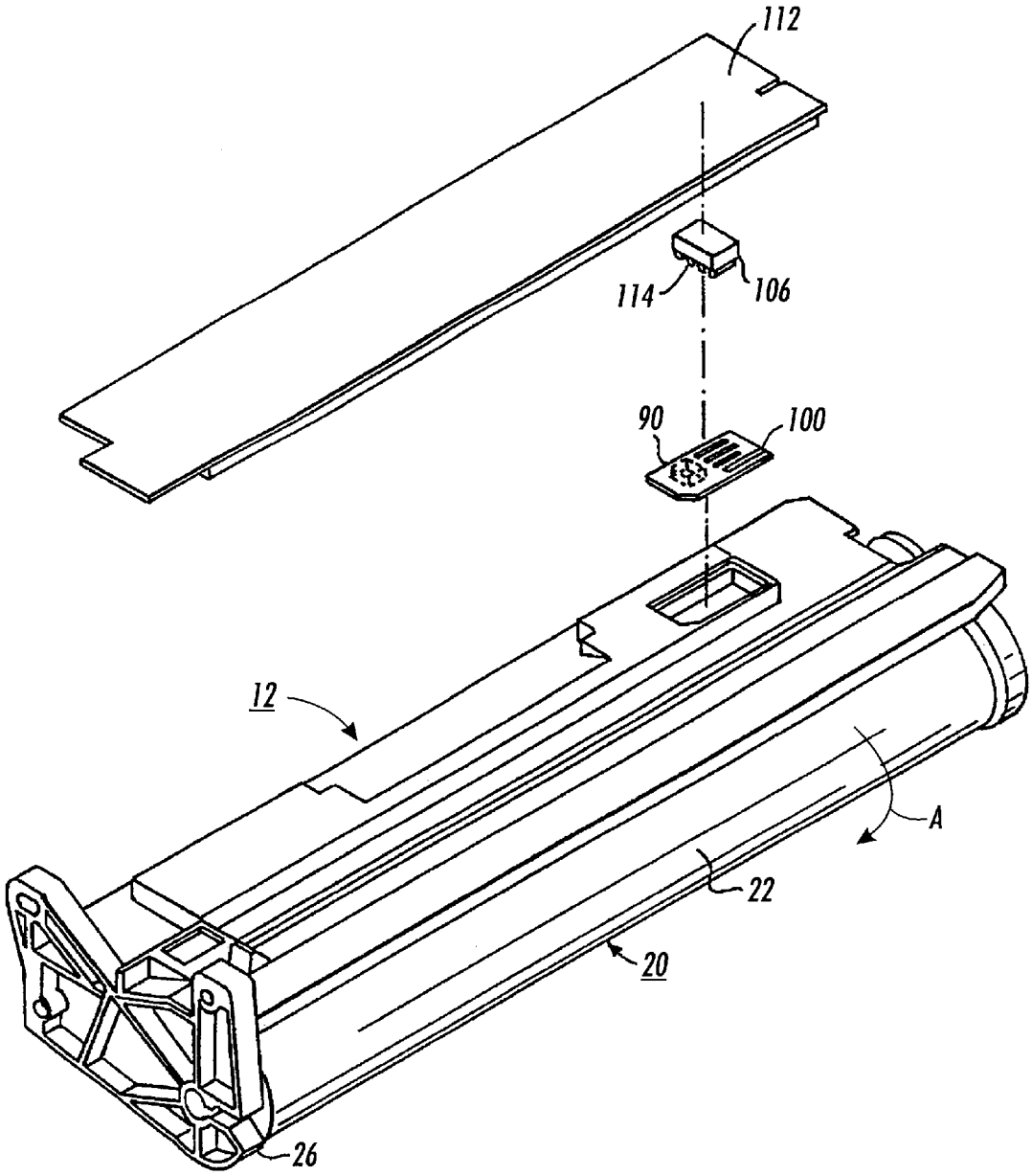
FIG. 2 is an isometric view of the replaceable Photoreceptor cartridge for the machine shown in FIG. 1, together with the mechanism for establishing electrical contact between the CRUM on the Photoreceptor cartridge and the machine control unit upon insertion of the cartridge into the machine.

Photoreceptor cartridge 12, illustrated in FIGS. 1 and 2, includes a photoreceptor drum 20, the outer surface 22 of which is coated with a suitable photoconductive material, and a charge corotron 24 (not shown in FIG. 2) for charging the photoconductive surface 22 in preparation for imaging. The drum 20 is rotationally mounted within a cartridge body 26. The drum rotates in the direction indicated by arrow A, in order to move the photoconductive surface consecutively through exposure 32, developer 34, and transfer 36 stations, as illustrated in FIG. 1. To receive the Photoreceptor cartridge 12, a suitable cavity 38 is provided in machine frame 18. The Photoreceptor cartridge body 26 and cavity 38 have complementary shapes and dimensions, such that upon insertion of the cartridge 12 into the cavity 38, the drum 20 is in a predetermined operating relation with the exposure 32, developer 34, and transfer 36 stations. Upon insertion of the cartridge 12 into the cavity 38, the drum 20 is drivingly coupled to the drum driving means (not shown) and the electrical connections to the cartridge 12 are made.

During the electrostatographic process, the photoconductive surface 22 of the drum 20 is initially uniformly charged by the charge corotron 24. The charged surface is then rotated to the exposure station 32, where the charged photoconductive surface 22 is exposed by an imaging beam 40 creating an electrostatic latent image on the photoconductive surface 22 of the drum 20. The imaging beam 40 is derived from a laser diode 42, or other suitable source, and is modulated in accordance with image signals from an image source 44. The image signal source 44 may comprise any suitable source of image signals, such as memory, document scanner, communication link, etc. The modulated imaging beam 40 output by the laser diode 42 is impinged on the facets of a rotating multi-faceted polygon 46, whereby the beam is swept across the photoconductive surface 22 of the drum 20 at the exposure station 32.

Figure 3:
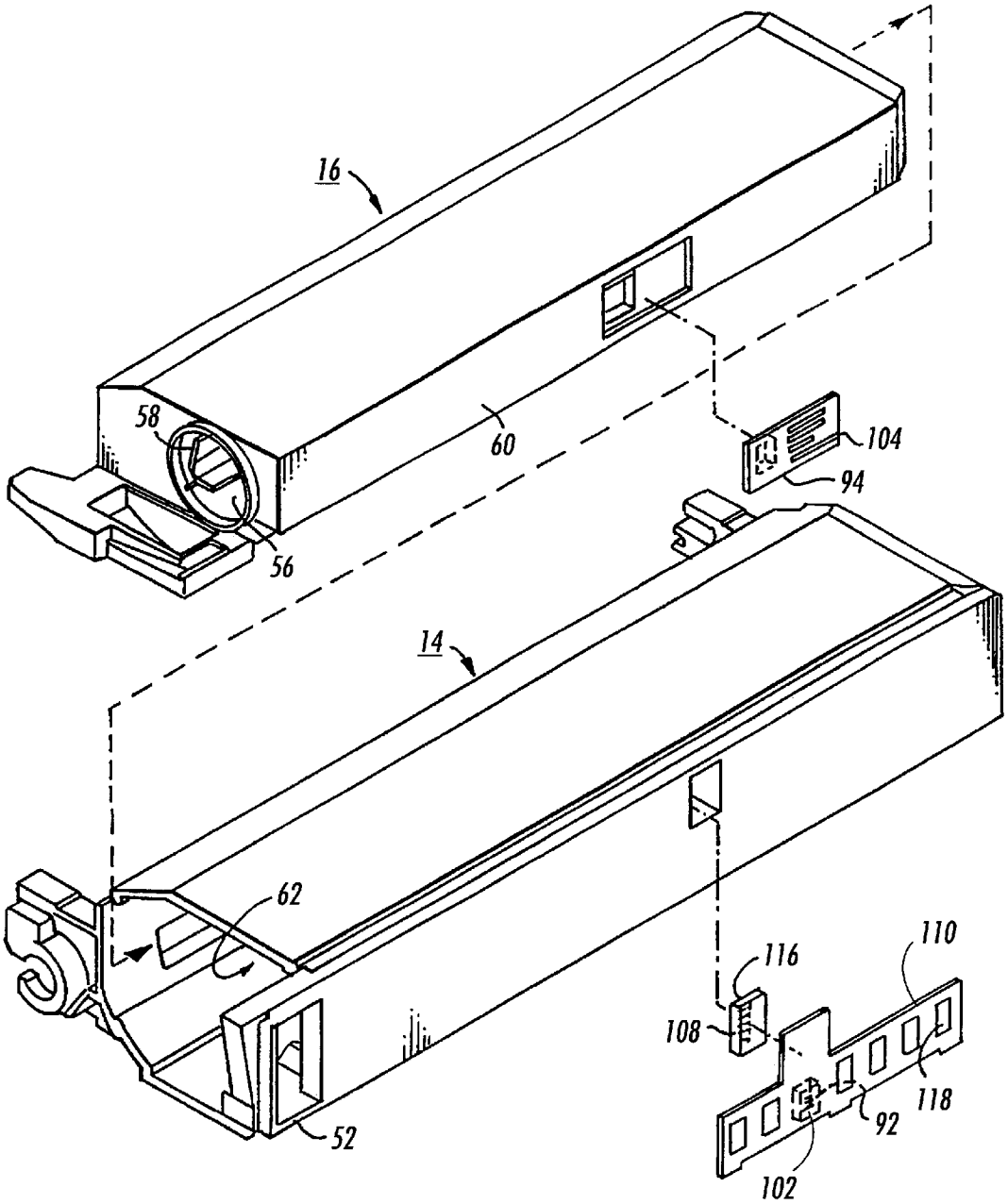
FIG. 3 is an isometric view of replaceable developer and toner cartridges for the machine shown in FIG. 1, together with the mechanism for establishing electrical contact between the CRUM'S on the developer and toner cartridges and the machine control unit upon insertion of the cartridges into the machine.

Following exposure, an electrostatic latent toner image is developed on the photoconductive surface 22 of the drum 20 at the developer station 34 by a magnetic brush development system contained in the developer cartridge 14, illustrated in FIGS. 1 and 3. The magnetic brush development system includes a suitable magnetic brush roll 50 (not shown in FIG. 3) rotatably mounted in body 52 of the developer cartridge 14. Developer is supplied to the magnetic brush roll 50 by the toner cartridge 16. To receive the developer cartridge 14, a suitable cavity 54 is provided in the machine frame 18. The developer cartridge body 52 and the cavity 54 have complementary shapes and dimensions, such that upon insertion of the developer cartridge into the cavity, the magnetic brush roll 50 is in a predetermined developing relation with the photoconductive surface 22 of the drum 20. Upon insertion of the developer cartridge 14, the magnetic brush roll 50 is drivingly coupled to a developer driving means (not shown) in the machine 10 and the electrical connections to the developer cartridge 14 are made.

The toner cartridge 16, illustrated in FIGS. 1 and 3, includes a sump 56 containing developer. The developer comprises a predetermined mixture of carrier and toner. A rotating auger 58 mixes the developer in the sump 56 and transfers developer to the magnetic brush roll 50. The auger 58 is rotatably mounted in the body 60 of the toner cartridge 16.

As seen best in FIG. 3, the body 52 of the developer cartridge 14 includes a cavity 62 formed therein for receipt of the toner cartridge 16. The cavity 62 in the developer cartridge 14 and the body 60 of toner cartridge 16 have complementary shapes and dimensions, such that upon insertion of the toner cartridge into the cavity, the toner cartridge 16 is in predetermined operating relation with the magnetic brush roll 50. Upon insertion of the toner cartridge 16 in the cavity 62, the auger 58 is drivingly coupled to the developer driving means (not shown) and the electrical connections to the toner cartridge are made.

With reference to FIG. 1, prints of the images formed on the photoconductive surface of the photoreceptor drum 20 are produced by the machine 10 on a suitable support material, such as copy sheet 68 or the like. A supply of copy sheets 68 is provided in a plurality of paper trays 70, 72, 74. Each paper tray 70, 72, 74 has a feed roll 76 for feeding individual sheets from stacks of sheets stored in the trays 70, 72, 74 to a registration pinch roll pair 78. The sheet is forwarded to the transfer station 36 in proper timed relation with the developed image on the photoreceptor drum 20. The developed image is transferred to the copy sheet 68 at the transfer station 36 in a known manner. Following transfer, the copy sheet bearing the toner image is separated from the photoconductive surface 22 of the photoreceptor drum 20 and advanced to a fixing station 80. At the fixing station, a roll fuser 82 fuses the transferred toner image to the copy sheet in a known manner. A suitable sheet sensor 84 senses each finished print sheet as the sheet passes from the fixing station 80 to an output tray 86. Any residual toner particles remaining on the photoconductive surface 22 of the photoreceptor drum 20 after transfer are removed by a suitable cleaning mechanism (not shown) contained in the Photoreceptor cartridge 12.

Referring again to FIGS. 2 and 3, each cartridge 12, 14 and 16 includes an identification and monitor chip or CRUM (Consumer Replaceable Unit Monitor) 90, 92 and 94. Each CRUM includes an Electrically Erasable Programmable Read Only Memory (EEPROM), or other suitable non-volatile memory device for the storage of data. In order to ensure that only the correct type of Photoreceptor 12, developer 14, and toner 16 cartridges are used in the machine 10, a code that identifies the type of the cartridge is pre-programmed into each CRUM's memory during manufacture. Other useful data, such as the type of toner or developer in the cartridge, batch number, serial number, term of a warranty or pre-paid license, etc., may also be pre-programmed in a CRUM's memory during manufacture. In order to track the usage of each cartridge, a running count of the number of images made with each cartridge is maintained in each cartridge's CRUM 90, 92, 94 during operation of the machine 10. Contact pads 100, 102, 104 enable the CRUM's 90, 92 and 94 to be electrically connected and disconnected with corresponding contact pads or terminals on the machine 10 upon installation or removal of the cartridges. Terminal blocks 106, 108 and a terminal board 110 cooperate with the contact pads to complete the electrical connection between the CRUM'S 90, 92, 94 and the machine 10.

As seen in FIG. 2, the terminal block 106 for the photoreceptor cartridge 12 is mounted on a terminal board 112. The terminal board 112 is located in the cavity 38 in the machine frame 18 within which the photoreceptor cartridge fits. Upon installation of the Photoreceptor cartridge 12 into the cavity 38, the contact pads 100 on the Photoreceptor cartridge's CRUM 90 engage contacts 114 of the terminal block 106, thereby forming the electrical connection between the CRUM 90 and the machine.

As seen in FIG. 3, the terminal block 108 for the toner cartridge 16 is mounted on the terminal board 110, which is attached to the developer cartridge housing 52. The CRUM 92 for the developer cartridge 14 is also mounted on the terminal board 110. Upon installation of the toner cartridge 16 into the cavity 62 in the developer cartridge housing, the contact pads 104 of the toner cartridge CRUM 94 engage contacts 116 of the terminal block 108 on the terminal board 110. Upon installation of the developer cartridge 14 into the cavity 54 in the machine frame 18, contact pads 118 on the terminal board 110 engage contact pads (not shown) located in the cavity 54 in the machine. The CRUM 92 of the developer cartridge and the CRUM 94 of the toner cartridge 16 are thereby electrically connected to the machine via contact pads 118 on the terminal board 110.

Figure 4:
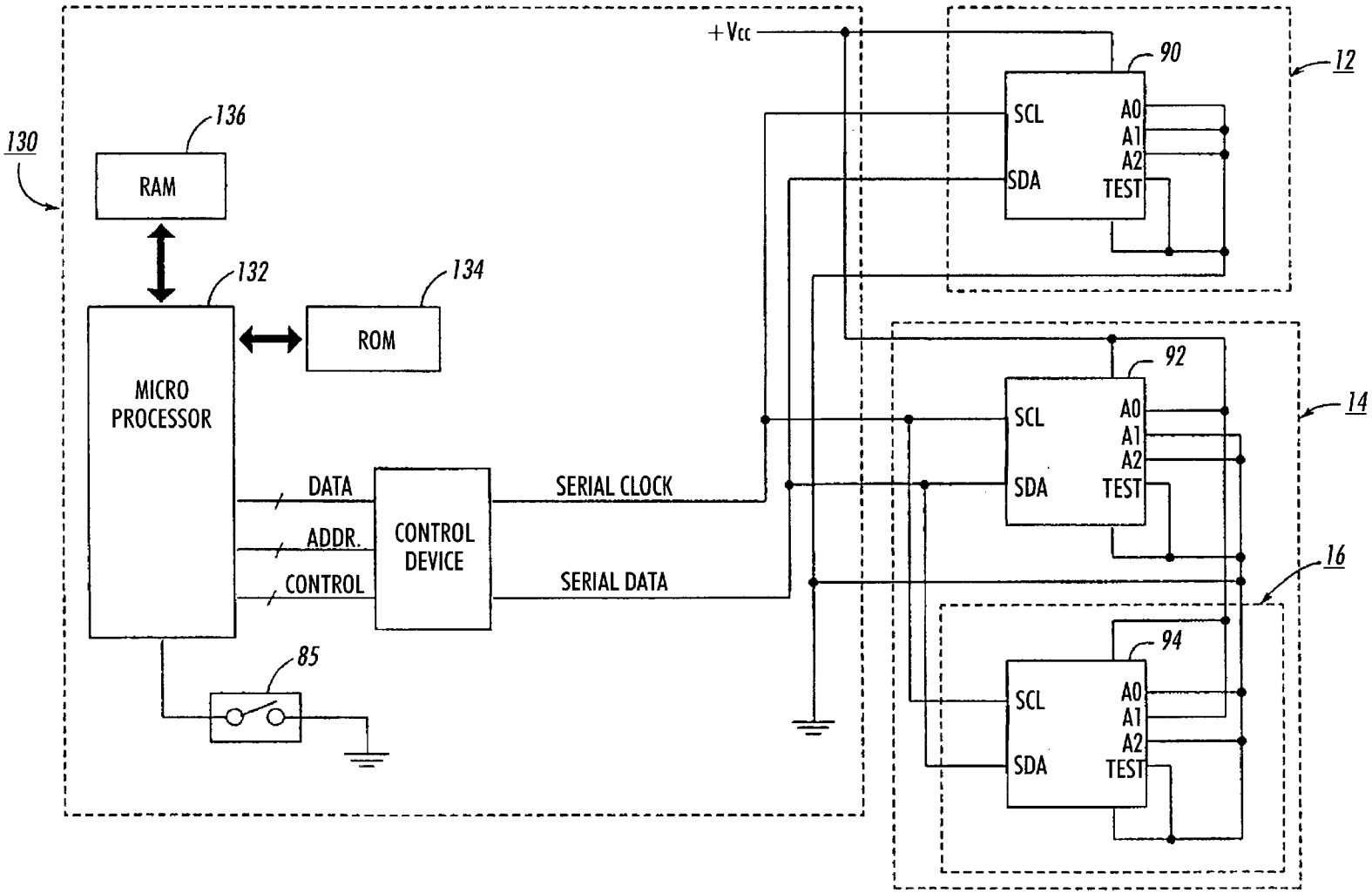
FIG. 4 is a schematic showing the machine control unit and its coupling with the CRUM'S of the Photoreceptor, developer and toner cartridges.

As previously mentioned, the CRUM's 90, 92 and 94 contain addressable memory (EEPROM'S) for storing or loging a count of the number of images remaining on each cartridge 12, 14 and 16. The current number of images produced by each cartridge, or current image count Y12, Y14 and Y16, is stored on the various EEPROM's by the machine control unit (MCU) 130 (see FIG. 4) at the end of each print run. Each cartridge's CRUM is initially pre-programmed during manufacture with a maximum count X12, X14 and X16, respectively, reflecting the maximum number of images that can be produced by the corresponding cartridge. Alternatively, the CRUM may be programmed with maximum count reflecting a licensed quantity of prints or images.

The counting system may be an incrementing or a decrementing type system. In an incrementing system, the current image count Y12, Y14 and Y16 in the CRUM's 90, 92 and 94, which is initially set to zero, are incremented as images are produced. When the current image count Y12, Y14 and Y16 reaches the maximum count X12, X14 and X16, the cartridge is rendered unusable. To alert or warn the customer when a cartridge is nearing the end of its useful of licensed life, a warning count W12, W14 and W16, that is somewhat less than the maximum count, is also pre-programmed into the CRUM's 90, 92 and 94. When the warning count is reached, a message is displayed in the display window 140 of the control panel 138 that warns the operator that the cartridge (or license) is nearing the end of its effective life and should be replaced soon. Typically, the warning count W12, W14 and W16 provides a few hundred to a few thousand images, depending on the type of machine involved, within which the operator must install a replacement cartridge, or renew a license by purchasing a new cartridge or calling a service technician, in order to ensure continued operation of the machine.

A suitable machine control unit (MCU) 130 (diagrammatically illustrated in FIG. 4) is provided for controlling operation of the various component parts of the machine 10 in an integrated fashion to produce prints. MCU 130 includes one or more microprocessors 132 and suitable memory, such as ROM 134 and RAM 136, for holding the machine operating system software, programming, data, etc. A control panel 138 (see FIG. 1) with various control and print job programming elements is also provided. Panel 138 additionally includes a message display window 140, for displaying various operating information to the machine operator.

Whenever the machine 10 is powered up, an initialization and security routine is performed by the MCU 130. During the initialization and security routine, the identification numbers of the cartridges 12, 14, and 16 are read from each cartridge's CRUM and compared with corresponding recognition numbers stored in the ROM 134 of the MCU 130. If the identification number of one of the cartridges does not match the recognition number for that cartridge, then the effected cartridge is disabled preventing operation of the machine 10 until a correct cartridge is installed. The effected cartridge may be disabled by setting a useful datapoint in the CRUM to a disabling value. For example, the current image count Y may be set to a value equal to or greater than the maximum image count X. Following which, the message 'Wrong Type Cartridge' is displayed in the display window 140.

When it is determined that the correct cartridges are installed, a check is made to see if any of the cartridges 12, 14, or 16 have reached the end of their useful, warranted or licensed life. The current image count Y12, Y14 and Y16 logged in each cartridge's CRUM is obtained and compared with the maximum number of images X12, X14 and X16. When the current image count on a cartridge is equal to or greater than the maximum number of images warranted or licensed for that cartridge, the message "End of Life" is displayed for the exhausted cartridge in the display window 140. Operation of the machine 10 is inhibited until the exhausted cartridge is replaced. When it is determined that none of the cartridges 12, 14, nor 16 have reached an end of life condition (and no other faults are found), the machine enters a standby state ready to make prints.

Upon a print request, the machine 10 cycles up and commences to make prints. The control unit 130 counts each time a finished print is detected by the print sensor 84 as the finished print passes from the fixing station 80 into the output tray 86. When the print run is completed and the machine cycles down, the total number of images made during the run, i.e., the image run count, is temporarily stored in RAM 136. The control unit retrieves the current image count Y12, Y14 and Y16 from the EEPROM 90, 92, 94 of each cartridge 12, 14, 16 and, using the image run count from the RAM, calculates a new current image count Y12, Y14 and Y16 for each cartridge's EEPROM. The control unit then writes the new current image count into the individual EEPROM's 90, 92 and 94 of each cartridge's CRUM.

Prior to recording the new current image counts Y12, Y14 and Y16 in CRUM's 90, 92 and 94, the control unit 130 compares each new current image count is Y12, Y14 and Y16 against the warning count W12, W14 and W16 stored in EEPROM's 90 of each cartridge's 12, 14, 16 CRUM. Where the current image count is equal to or greater than the warning count, a message "Order Replacement Cartridge" is displayed for the particular cartridge in the display window. This alerts the operator to the fact that the identified cartridge is about to expire and a new replacement cartridge should be obtained, if one is not already on hand. The new current image count Y12, Y14 and Y16 for each cartridge is also compared with the maximum number of images X12, X14 and X16. When the current image count is equal to or greater than the maximum number of images for any one of the cartridges 12, 14 or 16, that cartridge is disabled and the message "End of Life" is displayed for that cartridge in the display window 140. Control unit 130 prevents further operation of the machine 10 until the expired cartridge is replaced with a new approved cartridge.

It will be understood that, since the current image count Y12, Y14 and Y16 is updated and compared with the maximum number of images X12, X14 and X16 when machine 10 is cycled down at the end of an image run, it is possible for the current image count on a cartridge to exceed the maximum number of images X12, X14 and X16. This occurs when the current image count on a cartridge is close to zero at the start of a job run and the number of prints programmed for the job is greater than the number of images remaining on the cartridge. Rather than interrupt the job in midstream, cartridges 12, 14, and 16 are designed with a safety factor enabling a predetermined number of additional images over and above the maximum image count to be made.

Figure 5:
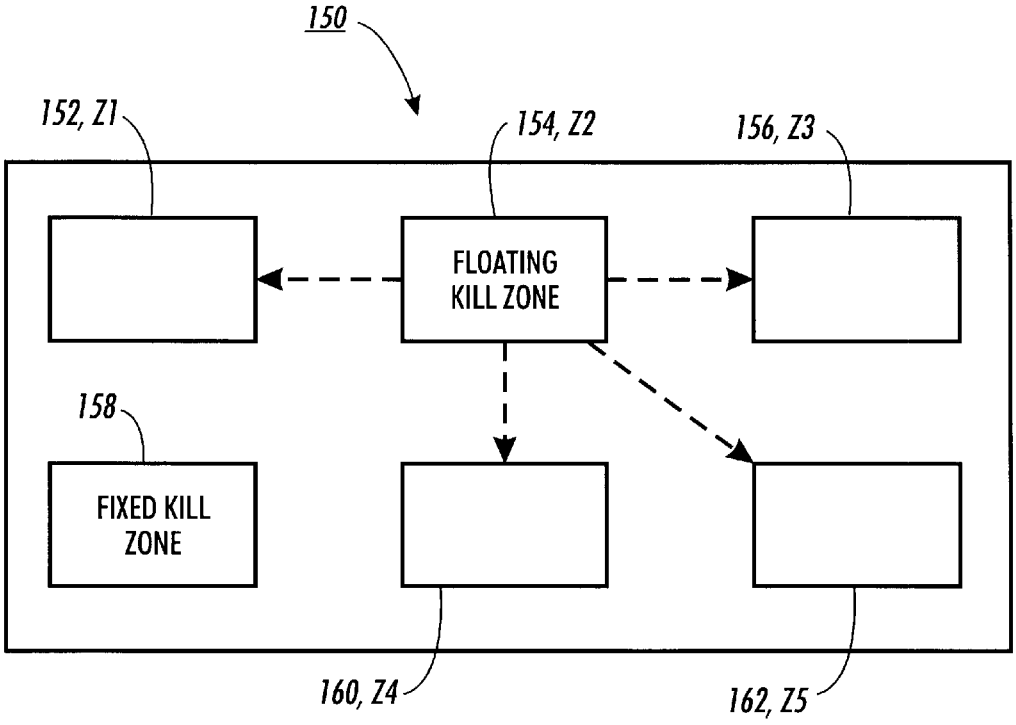
FIG. 5 is a diagrammatic illustration of a CRUM or smart card memory containing a floating dynamic kill zone according to one embodiment of the present invention.

FIG. 5 diagrammatically illustrates an EEPROM containing a floating kill zone according to the present invention. The illustrated EEPROM 150 contains six non-volatile memory locations 152, 154, 156, 158, 160 and 162. One of the memory locations 158 is illustrated as containing a fixed kill zone. The five remaining memory locations 152, 154, 156. 160 and 162 are reserved for the floating kill zone, and have been designated in FIG. 5 as available kill zone locations Z1, Z2, Z3, ZA, and Z5. It will be appreciated that a floating kill zone according to the present invention may be used without a fixed kill zone. It will also be appreciated that the EEPROM may have any number of available kill zone locations, Z1 through Zn, other than the illustrated five locations Z1–Z5.

When a fresh CRU having zero prints registered in the CRUM is installed in the machine 10. The machine control unit, MCU 130 (see FIG. 4), randomly selects one of the kill zone locations Z1–Z5 as a current kill zone location and randomly generates a random number, for example a five digit number, as a current security number. The controller then writes the generated current kill zone location and current security number into the MCU's ROM, and writes the current security number in the current kill zone location in the CRUM's EEPROM 150. The MCU periodically selects a random new current kill zone location and a random new current security number. The MCU then updates the current kill zone location and the current security number in the MCU's ROM, and writes the new current security number into the new current kill zone location in the CRUM's EEPROM. The MCU periodically reads the current security number and the current kill zone location from the ROM. The MCU then compares the current security number stored in the ROM, with the security number stored in the current kill zone location in the CRUM, in order to determine if the CRUM has been tampered with.

If the security number in the current kill zone in the CRUM does not match the current security number stored in the MCU, then an encrypted alert messaged is written into each kill zone location Z1–Z5. The encrypted message is subsequently read by a service technician, who may then report the occurrence to the manufacturer or supplier. The CRU may be programmed to allow the machine to continue operating. Continued operation will, however, be without guaranteed accuracy of continued print counts and without guaranteed accurate reorder and end of life messages for the effected CRU. As a result, continued operation of the machine at optimum performance can no longer be guaranteed. Alternatively, the CRU may be programmed to disable the effected CRU, and prevent further operation of the machine until a new CRU is installed.

Figure 6:
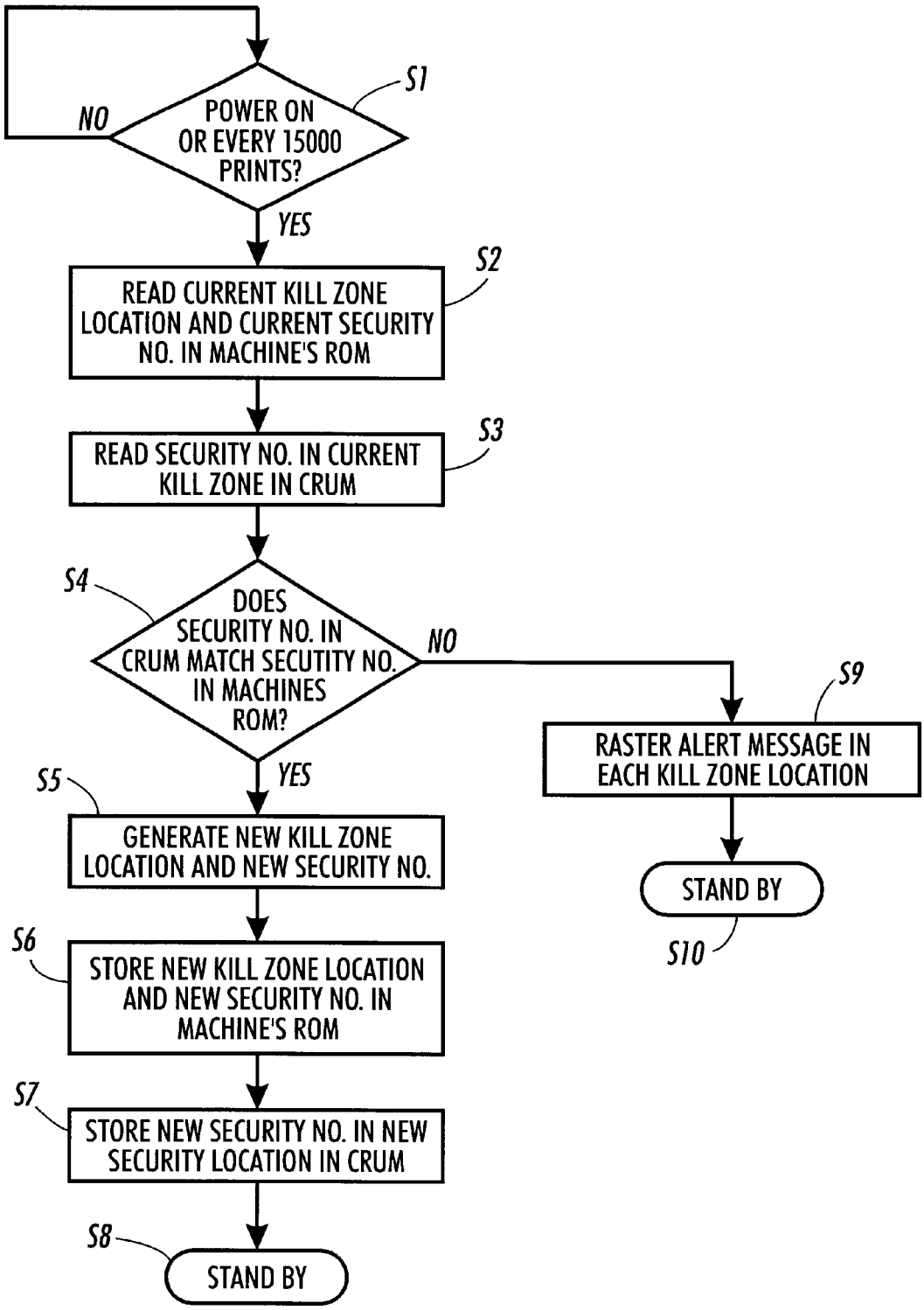
FIG. 6 is a simplified flowchart depicting the security process according to one embodiment of the present invention.

FIG. 6 is a flowchart illustrating, by way of example, one possible process for implementing a floating kill zone according to the present invention. After a predetermined interval, for example after every 15000 prints (step S1), the MCU 130 retrieves the current kill zone location and the current security number from the MCU's ROM (step S2). The MCU then reads the number stored in the kill zone location in the CRUM's EEPROM that corresponds with the retrieved current kill zone (step S3). The number retrieved from the current kill zone location in the CRUM is compared with the current security number retrieved from the ROM (step S4). If the two security numbers match, then the MCU randomly generates a new current kill zone location and randomly generates a new current security number and updates the CRU's memory accordingly (step S5). The new current security number is written into the machines ROM (step S6) new current kill zone location in the CRUM (step S7). The floating kill zone is thus moved to a new kill zone location, as indicated by the dashed arrows in FIG. 5, and the security number is changed to a new random number. Finally, the machine is placed in a stand by condition in preparation for making prints (step S8).

On the other hand, if the number retrieved form the current kill zone in the CRUM does not match the current security number retrieved from the MCU's ROM, then the MCU writes an encrypted "alert" message into each of the kill zone locations Z1–Z5 (step S9). The machine may then be placed in a stand by condition in preparation for making prints (step 510). The encrypted alert message will subsequently be detected by a service technician accessing the CRUM's memory. The technician will thereby be alerted that the integrity of the security kill zone may have been breached and that the automated print count that enables the CRU to provide messages regarding the expiration of cartridges and/or licenses may have been circumvented. The technician may then take appropriate action. Appropriate action may entail checking the condition of the CRU's to determine if any one of the CRU's has reached the end of its useful life and requires replacement or servicing. Appropriate action may also entail reporting the occurrence to the licensor or vendor, thereby alerting the licensor or vendor of a possible breach of a warranty condition or possible breach of a license.

The use of a CRUM having a floating or dynamic kill zone makes it more difficult to circumvent the security features of the CRUM when attempting to reverse engineer the architecture and programming of the CRUM. Since the kill zone is continually moving, it is difficult to determine its location. If one were to identify the location of the kill zone in the CRUM on any given CRU, it would not be of any assistance in later attempting to read and reprogram a different CRU. Since the floating kill periodically randomly moves to a new location, the odds are that the kill zone in one CRUM will not be in the same location as the kill zone in a different CRUM. As a result, it becomes much more difficult for one to reset a CRUM in order to extend the life of the CRU beyond its useful, warranted or licensed life span.

It will be appreciated that a floating kill zone according to the present invention may randomly move to a new location as described above, without a new security number being generated. The security number may be a constant number that is preset during manufacture of the CRUM. In this case, the security number may be removed from the previous kill zone location.

While the present invention has been disclosed as implemented by means of replaceable photoreceptor, developer, and toner cartridges, the invention is not limited to the number and types of cartridges disclosed. It will be appreciated that the present invention is equally well suited to any application in which one or more replaceable cartridges, such as those described or other cartridges or replaceable modules, are used.

Figure 7:
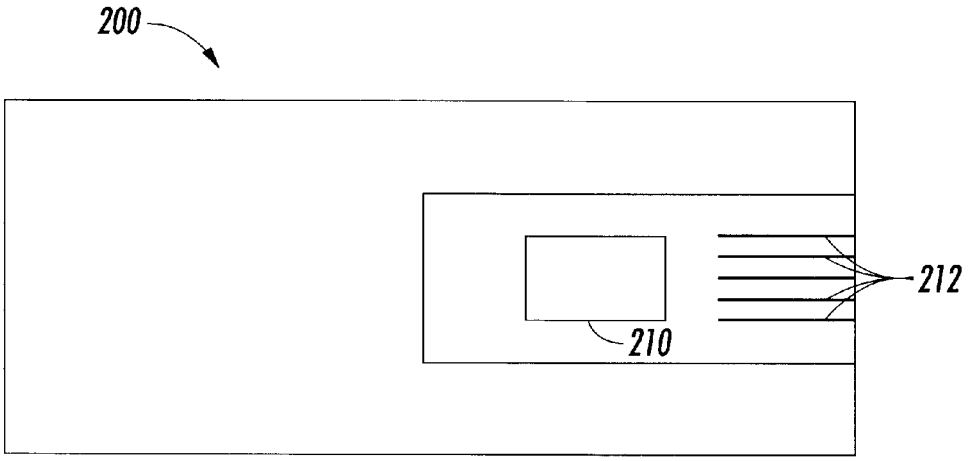
FIG. 7 is a diagrammatic illustration of a smart card according to an alternative embodiment of the present invention.

According to an alternative embodiment of the present invention, the previously described floating kill zone above may be used in a "smart card". A possible smart card 200 is diagrammatically illustrated by way of example in FIG. 7. In the same manner as the previously described CRUM's, the smart card 200 includes an identification and monitor chip 210. Each chip 210 includes an Electrically Erasable Programmable Read Only Memory (EEPROM), or other suitable non-volatile memory device for the storage of data. Contact pads or terminals 212 on the card 200 enable the chip 210 to be electrically connected and disconnected with corresponding contact pads or terminals (not shown) in a card reader 220 (See FIG. 1). Upon insertion of the card into a slot 222 in the face of the card reader 220, the contact terminals cooperate to electrically connect the smart card 200 with the appliance's controller or a networked home or central server/controller.

The memory contained in the chip 210 on the smart card 200 may take the same form as previously described in relation to a CRUM and illustrated in FIG. 5. FIG. 5 diagrammatically illustrates an EEPROM 150 containing six non-volatile memory locations 152, 154, 156, 158, 160 and 162 containing a floating kill zone according to the present invention. The operation of a memory having a floating kill zone has been described above in relation to a CRUM in a reprographic machine. The operation of a floating kill according the present invention is the same for a smart card as it is for a CRUM.

The information stored in the memory of a smart card 200 may be information identifying the owner of the card, along with security information such as security codes. The information on the card may, for example, identify the owner of the card and what resources or machines the owner is authorized to access. The information may also provide billing information such billing rates based on the type of user or department and the account or department to be charged.

In order to gain access to an appliance, the user must first insert the smart card 200 into a card reader 220 (see FIG. 1) attached to or built into the appliance. The card reader reads the information and security codes contained in the memory on the smart 200 and sends the information and codes to a controller for verification. The controller may be incorporated in the card reader or the appliance, or may be connected to the card reader and the appliance via an internal computer network, the internet, or any other known type of data transfer system or network (not shown). The controller verifies the information and security codes, and determines if the owner of the card is approved to access the appliance. Upon use of the appliance, the appliance's controller or the card reader may connect with a central computer and communicate the billing information on the card and current usage to the central computer. The central computer may accumulate the billing information and automatically generate bills or invoices for billing the user.

The smart card may alternatively be a pre-paid card containing information regarding current account balance in dollars or number of available units, such as images or other types of machine output or services, along with the identifying and security information. When the card is used to gain access to and use an appliance, the cost of the current usage of the appliance or number of units consumed is automatically deducted from the current balance and the new balance is stored in the card's memory. When the balance reaches zero, a user can no longer use the card to activate an appliance. The user must either purchase a new pre-paid card or pay the service provider to reset the balance on the card in order to continue using the appliance. The correct security codes, known only to the service provider, are required to reset the balance in the card's memory.

The smart card has been illustrated by way of example in FIG. 1 as making electrical contact with terminals in a card reader. The card may alternatively make a wireless connection with the card reader. The card reader may be a radio frequency transceiver and the chip 210 on the smart card may be a radio transponder employing a read/write radio frequency, thus eliminating the need for electrical terminals 212. It may be necessary with such an arrangement to insert the card into a card reader. Alternatively, it may only be necessary that the card be located in a prescribed area near the card reader. Other types of wireless communication, for example optical, such as infrared, or magnetic communication may be used in place of a read/write radio frequency. Such wireless types of communication are well known in the art and are therefore not described in detail herein.

A smart card according the present invention may be used to obtain controlled access to and automatic billing for appliances, such as printers, copy machines, telecopiers, facsimile machines, satellite television receivers, telephones, pagers, washers and dryers at a Laundromat, video arcade machines, and many other types of devices. The smart card according to the present invention may take the form of a security badge or ID required to gain access to a building or other sensitive site. One of skill in the art may envision many types of appliances, services and billing arrangements that may be implemented using a smart card according to the present invention.

The invention has been described by way of example with reference to the structure disclosed and illustrated. The invention is not confined to the details set forth, but is intended to cover such modifications or changes as may come within the scope of the following claims.

What is claimed is:

1. A security method for a smart card comprising the steps of:

a) providing said smart card with a memory source having a plurality of addressed floating memory locations;

b) randomly selecting one of said floating memory locations as a security location:

c) writing a security code into said security location, and d) periodically repeating steps b) and c).

2. The method of claim 1, further comprising the step of removing said security code from the previous said security location.

3. The method of claim 1, further comprising the steps of:

providing an appliance memory device in an appliance;

storing said security code in said appliance memory device;

storing the address of said security location in said appliance memory device: and periodically comparing a security code in a said floating memory location at said address stored in said appliance memory device with said security code in said appliance memory device.

4. The method of claim 3, further comprising the step of, if said code in said floating memory location at said address stored in said appliance memory device is not the same as said security code in said appliance memory device, then writing an alert code into each of said addressed memory locations.

5. The method of claim 4, wherein said alert code is encrypted.

6. The method of claim 4, further comprising the step of, if said code in said floating memory location at said address stored in said appliance memory device is not the same as said security code in said appliance memory device, then disabling the smart card.

7. The method of claim 4, further comprising the step of, if said code in said floating memory location at said address stored in said appliance memory device is the same as said security code in said appliance memory device, then placing the appliance in a stand by mode ready to provide service.

8. The method of claim 1, wherein step c) further comprises randomly generating a number as said security code.

9. The method of claim 4, wherein step c) further comprises randomly generating a number as said security code.

10. The method according to claim 1, wherein step d) comprises repeating steps b) and c) after a predetermined number of images have been produced using said smart card.

* * * * *